US007815757B2

(12) United States Patent
Wakabayashi et al.

(10) Patent No.: US 7,815,757 B2
(45) Date of Patent: Oct. 19, 2010

(54) WATER-COOLING METHOD OF STEEL MATERIAL

(75) Inventors: Hisamoto Wakabayashi, Kitakyushu (JP); Yasumitu Kondo, Futtsu (JP); Tooru Akashi, Futtsu (JP)

(73) Assignees: Nippon Steel Corporation, Tokyo (JP); Nippon Steel Engineering Co., Ltd., Tokyo (JP)

( * ) Notice: Subject to any disclaimer, the term of this patent is extended or adjusted under 35 U.S.C. 154(b) by 446 days.

(21) Appl. No.: 11/918,290

(22) PCT Filed: Apr. 5, 2006

(86) PCT No.: PCT/JP2006/307686

§ 371 (c)(1), (2), (4) Date: Oct. 11, 2007

(87) PCT Pub. No.: WO2006/109814

PCT Pub. Date: Oct. 19, 2006

(65) Prior Publication Data

US 2009/0038715 A1 Feb. 12, 2009

(30) Foreign Application Priority Data

Apr. 12, 2005 (JP) ..... 2005-115049

(51) Int. Cl.
*C21D 1/26* (2006.01)
*C21D 11/00* (2006.01)

(52) U.S. Cl. ..... 148/503; 148/511; 148/660; 148/661

(58) Field of Classification Search ..... 148/500, 148/503, 511, 660, 661

See application file for complete search history.

(56) References Cited

U.S. PATENT DOCUMENTS 4,052,235 A * 10/1977 Nakaoka et al. ..... 148/623

FOREIGN PATENT DOCUMENTS

| | | |
|---|---|---|
| JP | 54-024211 A | 2/1979 |
| JP | 57-198218 A | 12/1982 |
| JP | 61-179820 A | 8/1986 |
| JP | 63-7339 A | 1/1988 |
| JP | 63-11623 A | 1/1988 |

* cited by examiner

*Primary Examiner*—Deborah Yee
(74) *Attorney, Agent, or Firm*—Kenyon & Kenyon LLP

(57) ABSTRACT

The oxide film thickness of the steel material surface ($d_{H2O}$+$d_{o2}$) is made to become 15 nm or less where post-treatment after water-cooling is not needed by suitably setting the conditions of the water-cooling start temperature ($T_i$), water-cooling end temperature ($T_o$), steel material thickness (d), concentration of solute oxygen in the cooling water ($D_o$), and cooling rate ($C_R$) in the equation of $d_{H2O}+d_{o2}=7.98\times10^{-4}(T_i-T_o)dD_o+\{5.50\times10^{-3}(T_i^2-T_o^2)-6.51(T_i-T_o)\}/C_R$.

3 Claims, 1 Drawing Sheet

WATER-COOLING METHOD OF STEEL MATERIAL

TECHNICAL FIELD

The present invention relates to a water-cooling method controlling the thickness of an oxide film of a heated steel material and steel material obtained by that water-cooling method.

BACKGROUND ART

A steel material is cast, then worked hot and/or cold to be formed into the product shape, then is annealed. The annealed steel material is chemically treated or plated on its surface. In this case, if an oxide film is formed on the surface, the surface will not be sufficiently chemically treated or plated and the subsequent coatability, plating adhesion, and corrosion resistance will be impaired. Therefore, an annealed steel material has to be cooled in a nonoxidizing manner.

When cooling a steel material in a nonoxidizing manner, it is cooled by nitrogen or another nonoxidizing gas. The reason is that if the gas contains oxygen or another oxidizing gas, the steel material will be oxidized.

If using water as the cooling medium, since the water itself is oxidizing, it is not possible to avoid oxidation of the steel material. However, if the steel material is thick or a relatively fast cooling rate is necessary, the required cooling rate cannot be obtained by cooling using gas and therefore cooling using water becomes necessary. In this case, the oxide film formed on the steel material surface has to be removed after annealing by pickling or other post-treatment.

As the method of cooling a steel material by a nonoxidizing manner when water-cooling the material, the method of reducing the solute oxygen in the cooling water (deaerating it) has been proposed.

Japanese Patent Publication (A) No. 54-24211 proposes the method of using water once deaerated by boiling for the cooling, Japanese Patent Publication (A) No. 57-198218 proposes the method of reducing the solute oxygen concentration in the cooling water to 0.01 ppm or less, and further Japanese Patent Publication (A) No. 61-179820 proposes a cooling facility provided with a deaeration facility.

The oxidation of a steel material during water cooling includes oxidation proceeding using solute oxygen as its oxidizing source and oxidation by the cooling water itself, but in the above patent documents, it is proposed to simply reduce the solute oxygen without understanding their contributions.

Japanese Patent Publication (A) No. 63-7339 considers the fact that there is oxidation due to solute oxygen and water and proposes an electrochemical technique for reducing the oxidation by the water.

However, the prior art does not differentiate between the thickness of the oxide film due to the solute oxygen in the water and the thickness of the oxide film due to the steam generated due to contact with the heated steel material (that is, the cooling water itself), identify the factors affecting the thicknesses of the oxide films, and quantitatively clarify the relationship between the thicknesses of the oxide films and the affecting factors.

DISCLOSURE OF THE INVENTION

As explained above, for cooling of a thick steel material or cooling requiring a relatively fast cooling rate, cooling using water is required, but with cooling using water, pickling or other post treatment are required for removing the oxide film formed on the steel material surface.

Therefore, the present invention provides a water-cooling method for a steel material not requiring post treatment to remove an oxide film after water-cooling and a steel material obtained by that water-cooling method.

The inventors investigated in detail the phenomenon of oxidation due to water containing solute oxygen and as a result were able to accurately find the contributions of oxidation due to oxygen and oxidation due to steam and, further, were able to find the limit of oxide film thickness leaving the appearance clean and not obstructing chemical treatment or plating. That is, they were able to find the suitable ranges for the water-cooling conditions enabling the oxide film thickness of the surface to be reduced leaving the appearance clean and without obstructing chemical treatment or plating.

The present invention provides a water-cooling method for water cooling a heated steel material characterized by controlling the thickness of the oxide film formed on the steel material surface by the following equation:

$$d_{H20}+d_{o2}=7.98\times10^{-4}(T_i-T_o)dD_o+\{5.50\times10^{-3}(T_i^2-T_o^2)-6.51(T_i-T_o)\}/C_R$$

where, $d_{H20}$: thickness of oxide film formed using steam as oxidizing source (nm)

$$d_{H2O}=\{5.50\times10^{-3}(T_i^2-T_o^2)-6.51(T_i-T_o)\}/C_R,\ \text{where, } T_o\geqq573\text{K}$$

$d_{o2}$: thickness of oxide film formed using solute oxygen as oxidizing source (nm)

$$d_{o2}=7.98\times10^{-4}(T_i-T_o)dD_o,\ \text{where, } T_o\geqq573\text{K}$$

$T_i$: water-cooling start temperature (K)

$T_o$: water-cooling end temperature (K)

d: steel material thickness (mm)

$D_o$: concentration of solute oxygen in cooling water ($mgL^{-1}$)

$C_R$: cooling rate ($Ks^{-1}$)

Further, the water-cooling method of the present invention is characterized in that the conditions of the water-cooling start temperature ($T_i$), water-cooling end temperature ($T_o$), steel material thickness (d), concentration of solute oxygen in the cooling water ($D_o$), and cooling rate ($C_R$) are in ranges giving an oxide film thickness of the steel material surface calculated by the above equation of 15 nm or less.

Further, the water-cooling method of the present invention is characterized by using cooling water reduced in solute oxygen by a deaeration apparatus to water-cool the heated steel material.

Furthermore, the steel material of the present invention is a steel material obtained according to the water-cooling method of the present invention characterized in that the oxide film thickness of the steel material surface is 15 nm or less.

According to the water-cooling method of a steel material of the present invention and the steel material obtained by this water-cooling method, the following effects can be obtained.

(1) The thickness of the oxide film formed using the solute oxygen in the cooling water as the oxidizing source is found as a function of the water-cooling start temperature, water-cooling end temperature, steel material thickness, and concentration of solute oxygen in the cooling water and the thickness of the oxide film formed using steam produced by evaporation of the cooling water as the oxidizing source is found as a function of the water-cooling start temperature, water-cooling end temperature, and cooling rate, so the conditions for obtaining the required oxide film thickness after water-cooling can be quantitatively set.

(2) The limit of the oxide film thickness leaving the water-cooled steel material surface clean in appearance and not obstructing chemical treatment and plating was discovered, so the target value of the oxide film thickness after water-cooling can be clearly set.

BEST MODE FOR CARRYING OUT THE INVENTION

Figure 1:
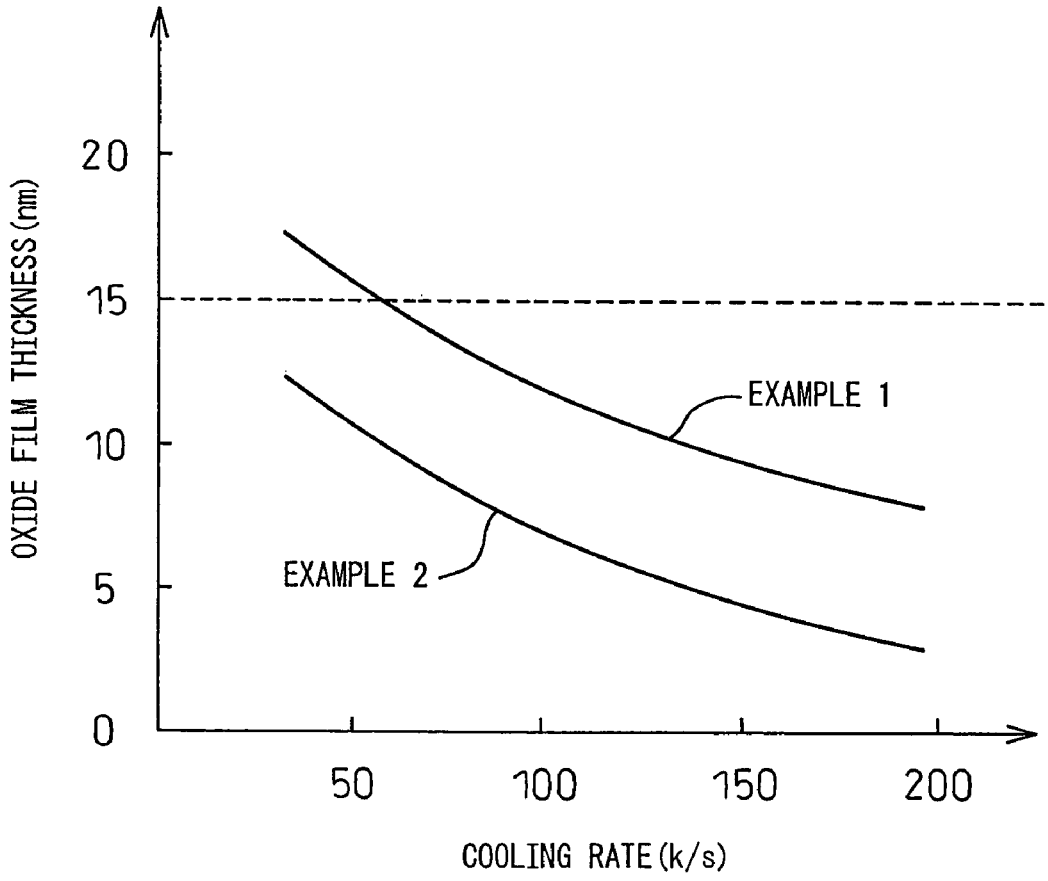
FIG. 1 is a view showing the relationship of the cooling rate and oxide film thickness in the water-cooling method of the present invention.

The inventors investigated in detail the phenomenon of oxidation due to water containing solute oxygen. As a result, they discovered that the phenomenon of oxidation due to water includes oxidation using solute oxygen as an oxidizing source and oxidation using steam as an oxidizing source. Furthermore, the inventors succeeded in quantitatively finding the oxidation rates using these as oxidizing sources and discovered that the sum of the thicknesses of the oxide films using these as oxidizing sources becomes the thickness of the oxide film formed at the time of water-cooling.

While water-cooling a heated steel material, the steel material is constantly being oxidized by the steam. The inventors accurately measured the steam oxidation of the steel material and thereby quantitatively found the steam oxidation rate. As a result, they learned that in oxidation by steam, (i) the oxidation rate is not dependent on the oxide film thickness, (ii) the oxidation rate is proportional to the steam speed, and (iii) the oxidation rate increases exponentially with respect to the temperature.

Expressing these by a mathematical formula, the following is obtained:

$$dw/dt=1.60\times10^{-5}\exp(-E/RT)P_{H2O}$$

where, dw/dt: oxidation rate ($gcm^{-2}\ s^{-1}$)

E: activation energy

E=−27100 ($Jmol^{-1}$)

R: gas constant

T: temperature (K)

$P_{H2O}$: steam partial pressure (atm)

It is possible to find the oxide film thickness of the steel material surface in the case of changing the water-cooling start temperature and cooling rate at the time of water-cooling a steel material by the following equation. In this case, the steam partial pressure is 1 atm.

$$d_{H20}=\{5.50\times10^{-3}(T_i^2-T_o^2)-6.51(T_i-T_o)\}/C_R,\ \text{where, } T_o\geqq573K$$

where, $d_{H2O}$: thickness of oxide film formed using steam as oxidizing source (nm)

$T_i$: water-cooling start temperature (K)

$T_o$: water-cooling end temperature (K)

$C_R$: cooling rate ($Ks^{-1}$)

During water-cooling, the steel is also oxidized by the solute oxygen in the cooling water, the oxidation rate due to oxygen is extremely fast, and the solute oxygen contained in the evaporated water is completely consumed for oxidation. Therefore, the thickness of the oxide film formed by the amount of evaporation of water is determined by the following equation from the specific heat of the steel, steel material thickness, water-cooling start temperature, and water-cooling end temperature:

$$d_{o2}=7.98\times10^{-4}(T_i-T_o)dD_o,\ \text{where } T_o\geqq573K$$

where, $d_{o2}$: thickness of oxide film using solute oxygen as the oxidizing source (nm)

$T_i$: water-cooling start temperature (K)

$T_o$: water-cooling end temperature (K)

d: steel material thickness (mm)

$D_o$: concentration of solute oxygen in the cooling water ($mgL^{-1}$)

The sum of the thickness of the oxide film formed due to water and the thickness of the oxide film formed due to solute oxygen is the thickness of the oxide film formed due to water-cooling.

$$d_{H20}+d_{o2}=7.98\times10^{-4}(T_i-T_o)dD_o+\{5.50\times10^{-3}(T_i^2-T_o^2)-6.51(T_i-T_o)\}/C_R$$

$T_i$: water-cooling start temperature (K)

$T_o$: water-cooling end temperature (K)

d: steel material thickness (mm)

$D_o$: concentration of solute oxygen in the cooling water ($mgL^{-1}$)

$C_R$: cooling rate ($Ks^{-1}$)

The inventors prepared steel materials given oxide films by cooling using water at the time of annealing and checked their appearances. The inventors were able to confirm that the water-cooled steel materials were colored in accordance with the oxide film thicknesses. That is, with an oxide film thickness of 15 nm or less, almost no temper color resulted and the materials had a metallic luster. However, with an oxide film of over 15 nm, a light yellow temper color resulted. Along with the increase in oxide film thickness, the temper color became darker. When over 30 nm, a brown temper color resulted.

Next, the inventors prepared steel materials given an oxide film by cooling using water at the time of annealing, chemically treated them, and evaluated them by the following three ways:

[1] Observation by the naked eye to determine whether the surface was uneven in color after chemical treatment, that is, macro observation.

[2] Observation by an SEM (scan type electron microscope) to determine whether there were parts without crystallization of chemical treatment, that is, micro observation.

[3] Measurement of amount of deposition to determine if chemical treatment film is sufficiently deposited.

(Note 1. Steel material was alkali degreased in ortho-sodium silicate, then rinsed with water, surface conditioned, then chemically treated by zinc phosphate. Note 2. For the chemical treatment solution, Palbond WL35 (tradename) was used. Treatment was performed at 35° C. for 2 minutes for evaluation.)

Furthermore, the inventors prepared steel materials given an oxide film by cooling using water at the time of annealing and evaluated them for plating adhesion as well.

(Note 3. The plating adhesion was evaluated by the hammer test prescribed in JIS H0401. It was evaluated by the absence of flaking or blisters upon being struck at 5 points.)

Table 1 shows the results of evaluation of the chemical treatment and plating adhesion. With an oxide film thickness of 15 nm or less, no problems occurred in the chemical treatment and plating adhesion. With an oxide film thickness of 15 to 30 nm, no problems occurred in the micro observation and amount of deposition of the chemical treatment or in the plating adhesion, but uneven color resulted in the chemical treatment. With an oxide film thickness of 30 nm or more, problems occurred in all of the evaluation items of the chemical treatment and in the plating adhesion.

In the prior art, removal of the oxide film formed by the water-cooling at the time of annealing was common sense. There was no idea of application of chemical treatment or plating while leaving the oxide film intact. In the present invention, the idea was changed to one that even if an oxide film is formed, it is ok if there is no problem in the chemical treatability or plateability. The appearance was also considered and the limit value of the oxide film thickness was set to 15 nm.

TABLE 1

| Oxide film thickness (nm) | Chemical treatment: Color evenness | Micro observation | Amount of deposition | Plating adhesion |
|---|---|---|---|---|
| 15 or less | Good | Good | Good | Good |
| 15 to 30 | Poor | Good | Good | Good |
| 30 or more | Poor | Poor | Poor | Poor |

When cooling a heated steel material by cooling water, to make the oxide film thickness 15 nm or less, it is sufficient to suitably adjust the adjustable conditions among the conditions having an effect on the oxide film thickness such as the water-cooling start temperature ($T_i$), water-cooling end temperature ($T_o$), steel material thickness (d), concentration of solute oxygen in the cooling water ($D_o$), and cooling rate ($C_R$). In particular, the concentration of solute oxygen in the cooling water can be adjusted by using a cooling facility having a deaeration apparatus.

EXAMPLES

FIG. 1 is a view showing the relationship between the cooling rate and oxide film thickness according to the water-cooling method of the present invention.

Table 2 shows the conditions of the steel material thickness (d), cooling start temperature ($T_i$), cooling end temperature ($T_o$), and solute oxygen concentration ($D_o$) used in the examples.

TABLE 2

| | Example 1 | Example 2 |
|---|---|---|
| Water-cooling start temperature ($T_i$) | 948 K | 948 K |
| Water-cooling end temperature ($T_o$) | 573 K | 573 K |
| Solute oxygen concentration ($D_o$) | 8 ppm | 0.1 ppm |
| Steel material thickness (d) | 1.6 mm | 1.6 mm |

From FIG. 1, it is clear that the solute oxygen concentration affects the oxide film thickness. Furthermore, from FIG. 1, it is possible to find the cooling rate able to maintain the oxide film thickness at the limit of oxygen film thickness of 15 nm or less where chemical treatment and plating are not obstructed after water-cooling.

According to the equation for finding the oxide film thickness of the present invention, it is possible to find the oxide film thickness by setting conditions of the water-cooling start temperature, water-cooling end temperature, steel material thickness, concentration of solute oxygen in the cooling water, and cooling rate, so it is possible to obtain a quantitative grasp over what ranges to set the controllable conditions so as to obtain the required oxide film thickness after water-cooling.

INDUSTRIAL APPLICABILITY

According to the present invention, it becomes possible to quantitatively set the conditions for obtaining the required oxide film thickness at the steel material surface after water-cooling. Further, it becomes possible to clearly set a target value of the oxide film thickness after water-cooling. Therefore, the present invention has a large applicability in the steel material production industry.

The invention claimed is:

1. A water-cooling method for water cooling a heated steel material, said water-cooling method for a steel material characterized by controlling the thickness of the oxide film formed on the steel material surface by the following equation:

$$d_{H20}+d_{o2}=7.98\times10^{-4}(T_i-T_o)dD_o+\{5.50\times10^{-3}(T_i^2-T_o^2)-6.51(T_i-T_o)\}/C_R$$

where, $d_{H20}$: thickness of oxide film formed using steam as oxidizing source (nm)

$$d_{H2O}=\{5.50\times10^{-3}(T_i^2-T_o^2)-6.51(T_i-T_o)\}/C_R$$

where, $T_o \geqq 573K$ $d_{o2}$: thickness of oxide film formed using solute oxygen as oxidizing source (nm)

$$d_{o2}=7.98\times10^{-4}(T_i-T_o)dD_o, \text{ where, } T_o 24\ 573K$$

$T_i$: water-cooling start temperature (K)

$T_o$: water-cooling end temperature (K)

d: steel material thickness (mm)

$D_o$: concentration of solute oxygen in cooling water ($mgL^-$)

$C_R$: cooling rate ($Ks^{-1}$).

2. A water-cooling method for a steel material as set forth in claim 1, characterized in that the water-cooling start temperature ($T_i$), water-cooling end temperature ($T_o$), steel material thickness (d), concentration of solute oxygen in the cooling water ($D_o$), and cooling rate ($C_R$) are in ranges giving an oxide film thickness ($d_{H20}+d_{o2}$) of the steel material surface, calculated by said equation, of 15 nm or less wherein said oxide film thickness leaves a water-cooled steel material surface clean in appearance and not obstructing chemical treatment or plating.

3. A water-cooling method for a steel material as set forth in claim 1 or 2 characterized by using cooling water reduced in solute oxygen by a deaeration apparatus to water-cool the heated steel material.

* * * * *